US005158290A

United States Patent [19]

Norris et al.

[11] Patent Number: 5,158,290

[45] Date of Patent: Oct. 27, 1992

[54] ELECTRONIC VARIABLE TARGET VALUE INDICATOR LOCATED ON THE PLAYFIELD OF A PINBALL MACHINE

[75] Inventors: Jon S. Norris, Streamwood; Robert J. Wilson, McHenry, both of Ill.

[73] Assignee: Premier Technology, Bensenville, Ill.

[21] Appl. No.: 691,336

[22] Filed: Apr. 24, 1991

[51] Int. Cl.[5] ..... A63F 7/32

[52] U.S. Cl. ..... 273/118 D; 273/127 R; 273/118 A

[58] Field of Search ..... 273/118-125, 273/127

[56] References Cited

U.S. PATENT DOCUMENTS

| | | | |
|---|---|---|---|
| 3,877,701 | 4/1975 | Foster et al. | 273/119 A |
| 4,037,842 | 7/1977 | Breslow | 273/127 R |
| 4,257,604 | 3/1981 | Grabel et al. | 273/127 R |
| 4,260,156 | 4/1981 | Momura | 273/127 R |
| 4,354,681 | 10/1982 | Garbark | 273/121 R |
| 4,460,175 | 7/1984 | Krynski | 273/121 A X |
| 4,804,186 | 2/1989 | Moravec | 273/121 A X |
| 4,822,046 | 4/1989 | Kim et al. | 273/121 A X |
| 4,892,309 | 1/1990 | Kim et al. | 273/127 R |

OTHER PUBLICATIONS

"Champion of the Games—Gottlieb's Torch", 1980 (2 pgs.).

*Primary Examiner*—Paul E. Shapiro
*Assistant Examiner*—Raleigh W. Chiu
*Attorney, Agent, or Firm*—Arnold, White & Durkee

[57] ABSTRACT

An electronic alphanumeric indicator is disposed at a target location on the playfield of a pinball machine. The electronic alphanumeric indicator, for example, is disposed just above and behind the target, or in the top portion of the target. For a drop target, the target is transparent and the electronic alphanumeric indicator is mounted on the back side of the target. The electronic alphanumeric indicator, for example, indicates the number of points associated with the target, or the time remaining for the player to complete a task on the playfield.

20 Claims, 5 Drawing Sheets

ELECTRONIC VARIABLE TARGET VALUE INDICATOR LOCATED ON THE PLAYFIELD OF A PINBALL MACHINE

BACKGROUND OF THE INVENTION

1. Field of the Invention

The present invention relates generally to pinball games, and more particularly to an indicator for indicating a variable value for a target on the playfield of a pinball game.

2. Description of the Related Art

Variable score values associated with targets in pinball machines have been indicated by rotary mechanical devices and multiple drop target assemblies.

A typical rotary mechanical device for indicating a variable target score value is shown in Kim et al. U.S. Pat. No. 4,892,309. A round bumper target has a round top plate marked with numerals. The top plate is rotated to indicate different target score values.

A multiple drop target assembly is shown in Garbark U.S. Pat. No. 4,354,681. Multiple drop targets are disposed one behind another and have different visual indicia that are successively exposed as the drop targets are struck by the pinball.

SUMMARY OF THE INVENTION

The primary object of the invention is to reduce mechanical failures of variable score indicators for targets on the playfields of pinball games;

Another object of the invention is to provide a variable target value indicator that can display a greater number of target values.

Yet another object to create new pinball features that are interesting and challenging to attract players.

Still another object is to create a variable target value indicator that will also indicate a time remaining to complete a task on the playfield.

Briefly, in accordance with the invention, the above objects are achieved by placing an electronic alphanumeric indicator at a target location on the playfield of a pinball machine. Preferably the electronic alphanumeric indicator is disposed in the target itself. The electronic alphanumeric indicator, for example, is a segmented LED display embedded in or mounted on the top portion of a bumper target or a drop target. The electronic alphanumeric indicator displays the score that a player will receive should the pinball hit the target. After a target is hit, the score is changed to a new value. The electronic alphanumeric indicator may also display the time remaining for a player to complete a task on the playfield.

BRIEF DESCRIPTION OF THE DRAWINGS

Further objects and advantages of the present invention will become apparent upon reading the following detailed description and upon reference to the drawings in which.

Figure 1:
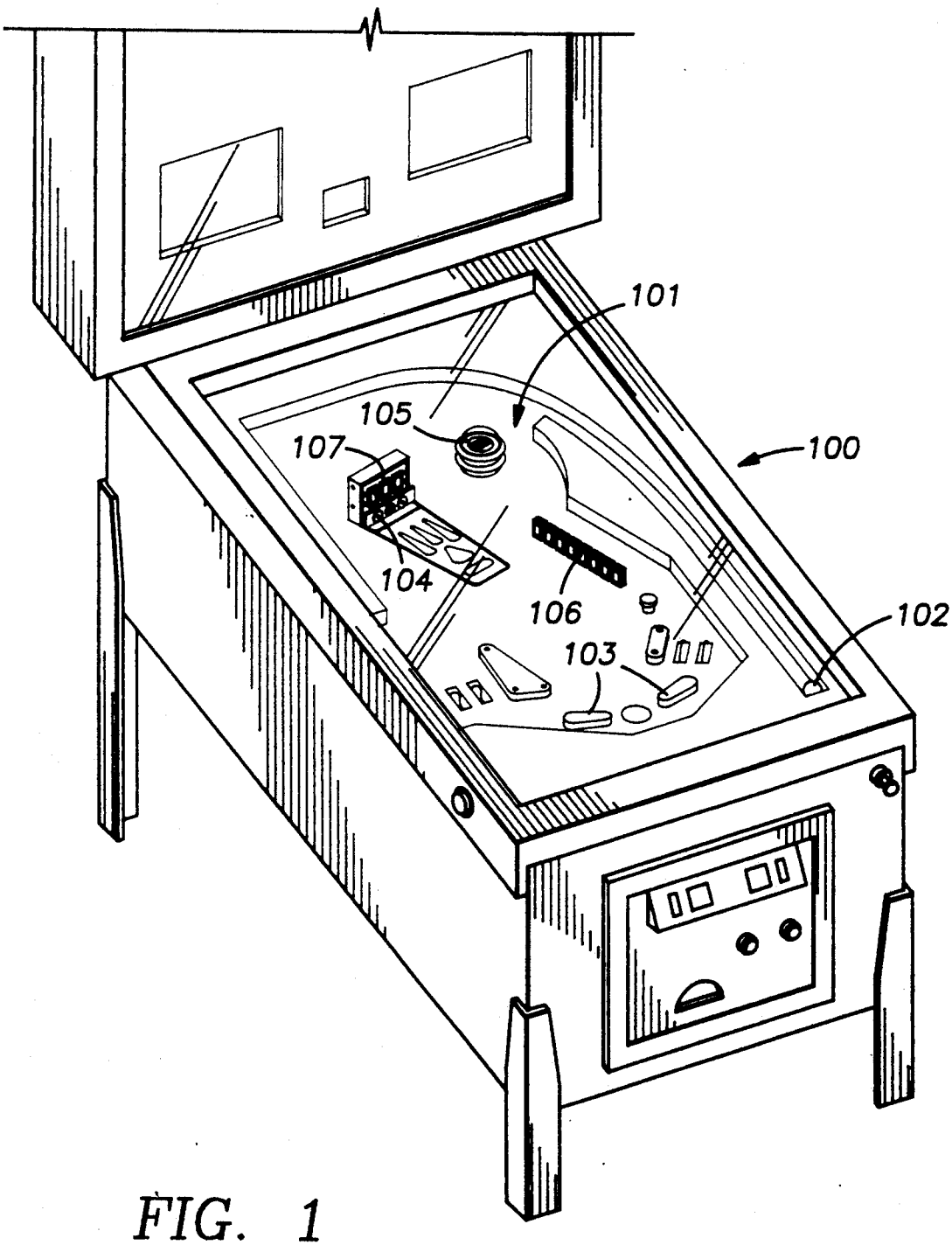
FIG. 1 is a perspective view of a pinball machine employing the present invention.

While the invention is susceptible to various modifications and alternative forms, specific embodiments thereof have been shown in the drawings and will be described in detail. It should be understood, however, that it is not intended to limit the invention to the particular forms disclosed, but on the contrary, the intention is to cover all modifications, equivalents and alternatives falling within the scope of the invention as defined by the appended claims.

DETAILED DESCRIPTION OF THE PREFERRED EMBODIMENTS

Turning now to FIG. 1 of the drawings, there is shown a pinball machine 100 employing the present invention. The pinball machine 100 has a playfield 101 over which a ball 102 travels under the influence of a player (not shown). During play, the ball 102 strikes a number of flippers 103 and targets 104, 105, and 106. The targets 104, 105, and 106 each include a switch (not shown) that detects impact of the ball 102 upon the target. Depending upon the state of the game, impact of the ball 102 upon a target causes the player's score to be increased (or possibly decreased) by a certain number of points. The target 105, known as a bumper target, may respond to impact with the ball 102 by energizing a solenoid (not shown) to cause the ball to be ejected from the target at an increased velocity. The targets 106, known as drop targets, may respond to impact with the ball 102 by dropping underneath the playfield 101.

The present invention more particularly concerns an improved method of indicating a variable target value such as a number of points to be awarded the player when the ball 102 strikes a particular target. In accordance with a basic aspect of the invention, a variable target value is indicated by an electronic alphanumeric indicator at the target location. For this purpose an array 107 of electronic alphanumeric indicators is mounted on the playfield 101 just above and behind the array of targets 104 so that an associated one of the electronic alphanumeric indicators is disposed at the location of each of the targets. Electronic alphanumeric indicators are embedded in the top portion of the bumper target 105, as further described below in conjunction with FIG. 3. An alphanumeric indicator is also mounted to each one of the drop targets 106, as further described below in connection with FIGS. 4A, 4B and 4C.

Figure 2:
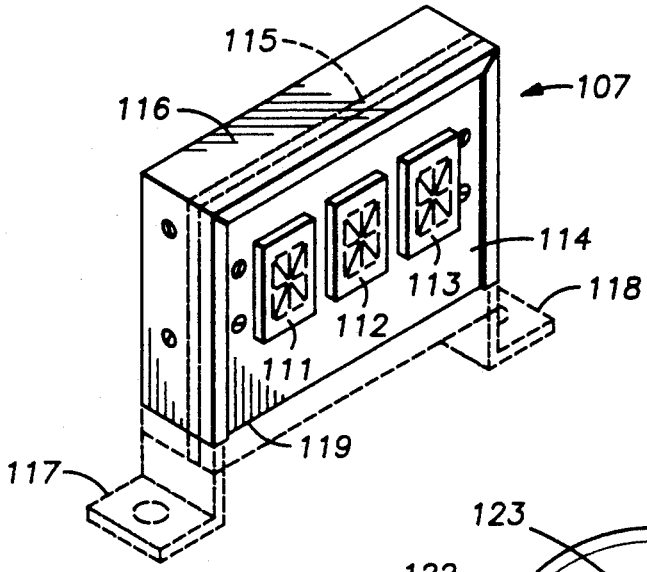
FIG. 2 is a perspective view of an assembly for mounting an array of electronic alphanumeric indicators just above and behind an array of targets in accordance with the invention.

Turning now to FIG. 2, the array 107 of electronic alphanumeric indicators is shown in greater detail. The array 107 includes three sixteen-segment LED displays 111, 112, and 113 that are mounted on a printed circuit board 114. The circuit board 114 is mounted on a block of wood 115. The top, left and right surfaces of the circuit board and the block of wood are covered by a sheet metal housing 116 formed by a box-and-pan break. The housing is formed with mounting ears 117, 118 which are fastened to the underside of the playfield (not shown). The level of the playfield surface is indicated in FIG. 2 by the solid line 119.

Figure 3:
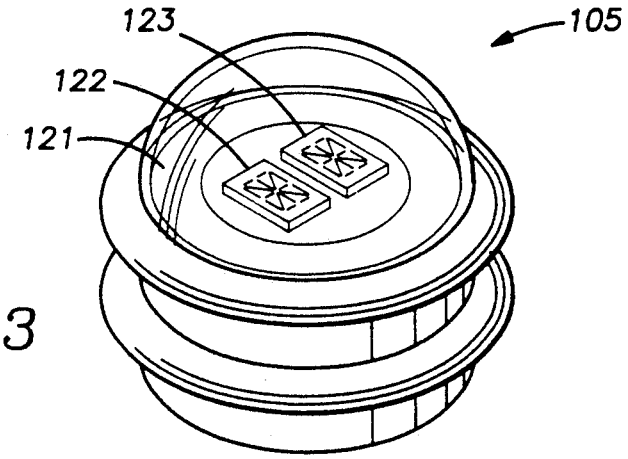
FIG. 3 is a perspective view of a bumper target including electronic alphanumeric indicators in accordance with the invention.

Turning now to FIG. 3, the bumper target 105 is shown in greater detail. The target 105 has a transparent top cover 121, and two sixteen-segment LED displays 122, 123 are mounted underneath the top cover.

Figure 4A:
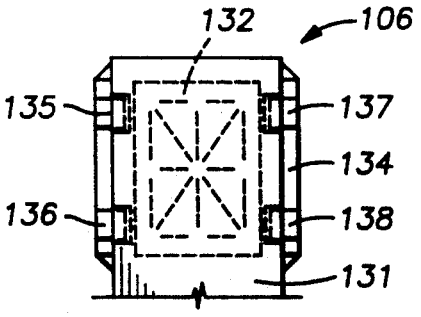
FIGS. 4A, 4B and 4C are front, side, and top views, respectively, of a drop target including an electronic alphanumeric indicator in accordance with the invention.
Figure 4C:
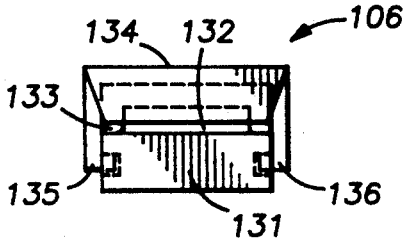
Figure 4B:
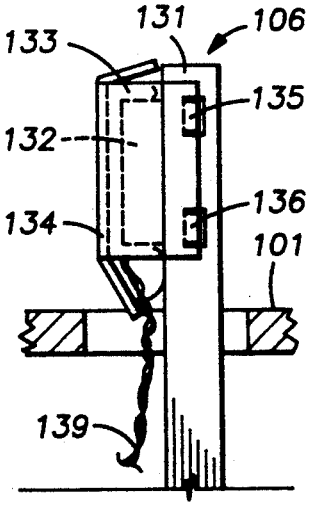

Turning now to FIGS. 4A, 4B, and 4C, there is shown a drop target 131 in the drop target array 106. A sixteen-segment LED display 132 is mounted to the back side of the drop target 131. The drop target 131 is made of transparent plastic, such as polycarbonate. To reduce the impact of mechanical shocks upon the LED display, the interface between the LED display and the drop target is lubricated with a film of clear silicone oil, and the LED display is mounted by double-sided resilient foam adhesive tape 133 to a metal fastening clip 134. The fastening clip has four tabs 135, 136, 137, 138 which are inserted into aligned cavities formed in side portions of the drop target 131. The fastening clip 134 is permanently deformed during this insertion operation. Electrical connections to the LED display are made by flexible wires 139 which run underneath the playfield 101.

Figure 5:
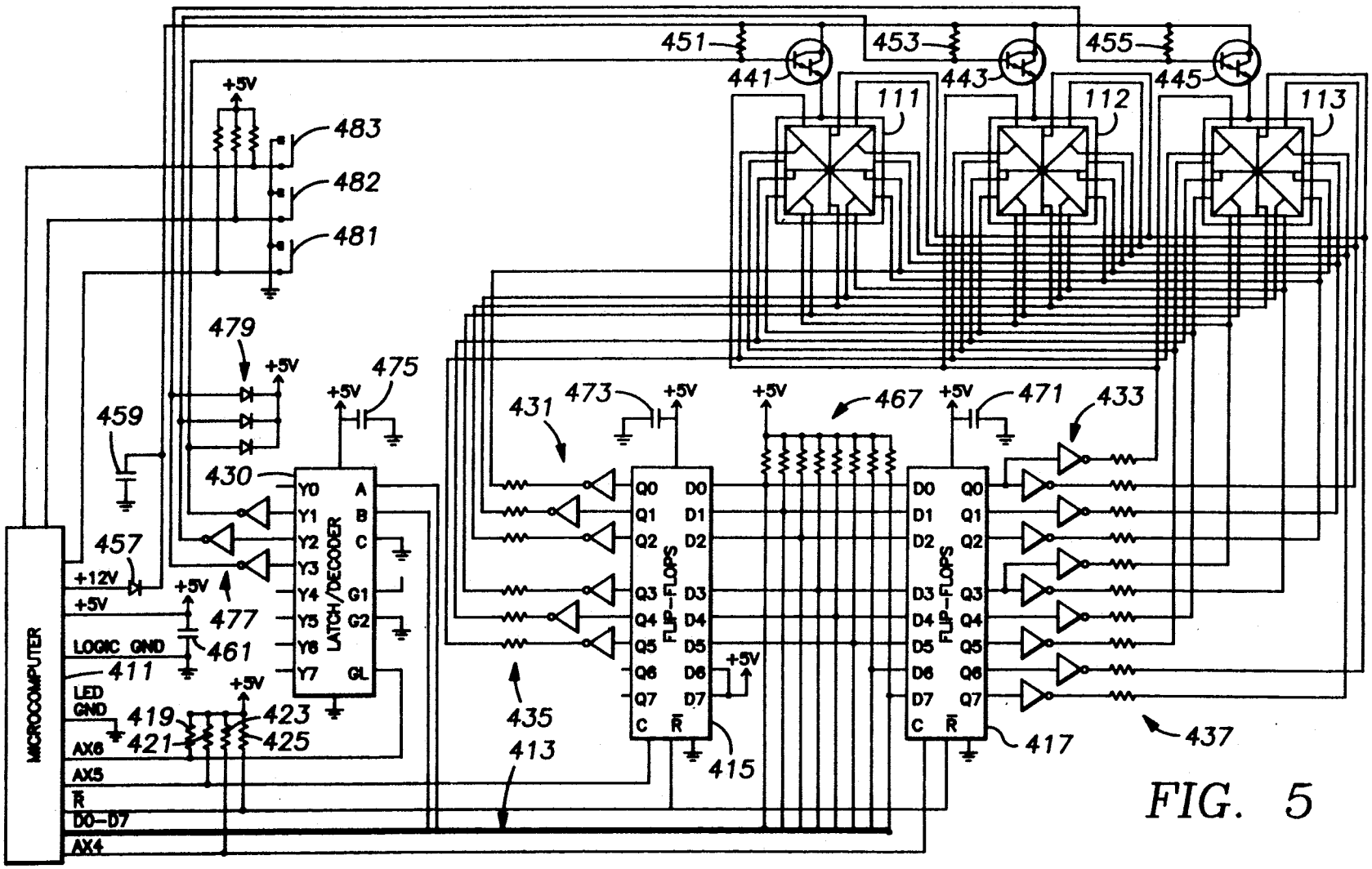
FIG. 5 is a schematic diagram of electrical circuits for driving the array of electronic alphanumeric indicators shown in FIG. 2.

Turning now to FIG. 5, there is shown a schematic diagram of electrical circuits associated with the three LED displays 111, 112, 113 previously shown in FIG. 2. For turning on and off the segments of the LED displays 111, 112, 113, a microcomputer 411 provides data signals D0–D7 on a data bus 413 to arrays of flip-flops 415 and 417, which form latches or registers, for example 74HC273 registers, which sample and hold the data signals. The data lines D0–D7 in the data bus 413 are also connected to a pull-up resistor pack 467, for example a 4.7K ohm ×8 resistor pack.

The microcomputer 411 also provides select signals AX4 and AX5 to respective clock inputs of the flip-flops 415 and 417, and a reset signal (R) active low for causing the flip-flops 415 and 417 to turn off all LED segments. In one advantageous arrangement, for example, the select signals AX4 and AX5 are provided by an address decoder (not shown) in the microcomputer 411 so that each of the arrays of flip-flops 415, 417 has an associated address, and the microcomputer can transfer a byte of data to a selected one of the arrays of flip-flops 415, 417 by writing the byte of data to the associated address of the selected array of flip-flops. The lines conveying the signals AX4 and AX5 are also connected to pull-up resistors 423 and 421, for example 4.7K ohm ±5%, ¼ watt resistors. The line conveying the reset signal (R) is connected to pull up resistor 425, for example a 100K ohm ±5%, ¼ watt resistor.

For selecting one of the three LED displays 111, 112, 113, the data signals D0 and D1 are also applied to inputs A and B respectively of a latch/decoder 430, for example a 74HC137 latch/decoder. A select signal AX6 is provided to a latch enable input (GL) of the latch/decoder 430 to enable the latch/decoder to receive and decode data. The line conveying the signal AX6 is also connected to a pull-up resistor 419, for example a 4.7K ohm ±5%, ¼ watt resistor.

The microcomputer 411 also provides a logic ground (GND), and +5V and +12V supply voltages. To ensure a steady logic supply voltage, a decoupling capacitor 461, for example a 10uF, 50V electrolytic capacitor, is connected between the LOGIC GND and the +5V logic supply.

The flip-flops 415 and 417 have outputs connected to arrays of drivers 431 and 433, for example ULN2803 drivers. The drivers are in turn connected to series resistors 435 and 437, for example 33 OHM ±5% ¼ watt resistors, which carry the flip-flop output signals to the cathode connections of the segments of the LEDs 111, 112 and 113.

The flip-flops 417, flip-flops 415 and latch/decoder 413 have their supply pins shunted by decoupling capacitors 471, 473, and 475 respectively. The decoupling capacitors 471, 473, and 475 are, for example, 0.1uF 16V capacitors.

The output signals of the decoder 430 are fed to buffers 477, for example, part no. 7416 buffers. The buffered signals then pass by diode clamps 479, for example 1N4148 diodes, to the bases of darlington driver transistors 441, 443, and 445, for example 2N6043 transistors. The emitters of the transistors 441, 443, and 445 are connected to the anodes of the respective LED displays 111, 112, and 113. The collectors of the transistors are connected to the 12V supply through a series diode 457, for example a 1N4004 diode, and are shunted to ground by a capacitor 459, for example a 0.1uF, 50V capacitor. Between the base and collector of each of the transistors 441, 443, and 445, is a respective pull-up resistor 451, 453, and 455. The pull-up resistors 451, 453, and 455 are, for example, 1.5K ohm ±5%, ¼ watt resistors.

Figure 6:
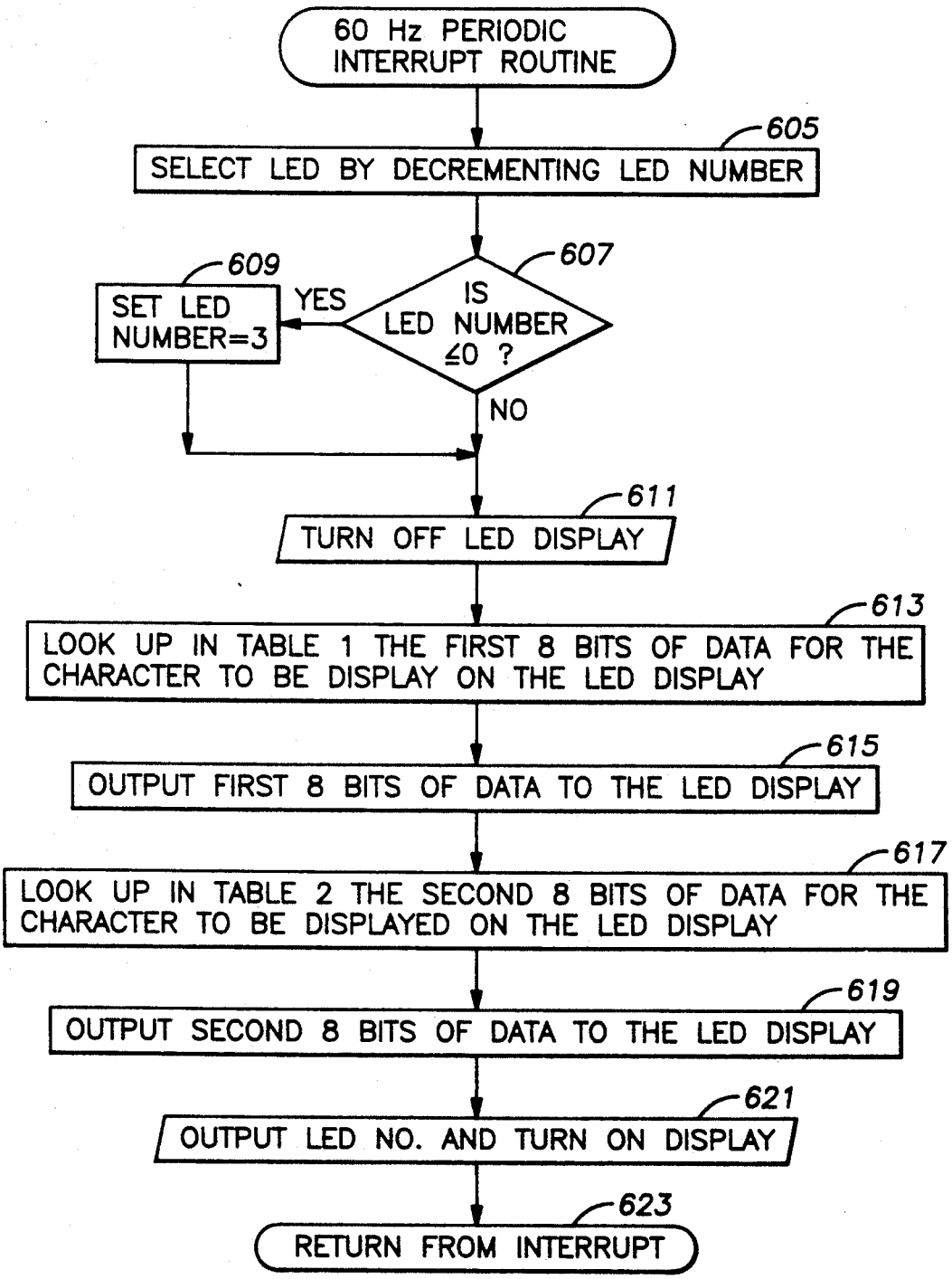
FIG. 6 is a flowchart of a microcomputer interrupt routine for operating the electrical circuits of FIG. 5.

FIG. 6 is a flowchart showing an interrupt routine 601 used by the microcomputer (411 in FIG. 5) every 60th of a second for operating the LED circuit of FIG. 5.

Beginning in step 605, the microcomputer selects a next LED to service by decrementing a variable called "LED number". In step 607, the microcomputer checks whether the variable "LED number" has been decremented to a number less than or equal to zero. If so, then in step 609 the microcomputer resets "LED number" to 3. In step 611, a value of zero is written to the preassigned address of the latch/decoder (430 in FIG. 5) to turn off the array of LED displays, so that segments for the newly selected LED can be selected when the array of LED displays is turned off.

To select the segments of the newly selected LED display, in step 613 the microcomputer looks up in a first table a first eight bits of segment data for the character to be displayed on the newly selected LED display. In step 615, the first eight bits of segment data are transmitted to the flip-flops 415 (FIG. 5). (This is done by writing the first eight bits of segment data to the preassigned address of the flip-flops 415). In step 617, the microcomputer looks up in a second table a second eight bits of segment data for the character to be displayed on the selected LED display. In step 619, the second eight bits of segment data are transmitted to the flip-flops 417. (This is done by writing the second eight bits of segment data to the preassigned address of the flip-flops 417.)

In step 621, the microcomputer turns on the LED display by transmitting the LED number of the newly selected LED display to the latch/decoder 430. (This is done by writing the LED number to the preassigned address of the latch/decoder 430.) This completes the interrupt routine. Therefore, in the final step 623, the microcomputer returns from the interrupt to a main program, which controls the state of the game. The main program, for example, determines the alphanumeric character to be displayed by each of the LED displays (111, 112 and 113 in FIG. 5). The alphanumeric characters, for example, may indicate a variable score for the associated target. The variable score could be incremented, for example, each time that the target is hit by the pinball. For this purpose, as shown in FIG. 5, the microcomputer 411 scans a respective switch 481, 482, 483 associated with each of the targets (104 in FIG. 1). Alternatively, the alphanumeric character could indicate the time remaining for the target to be active. In this case the indicated value could be decremented at a predetermined rate.

Figure 7:
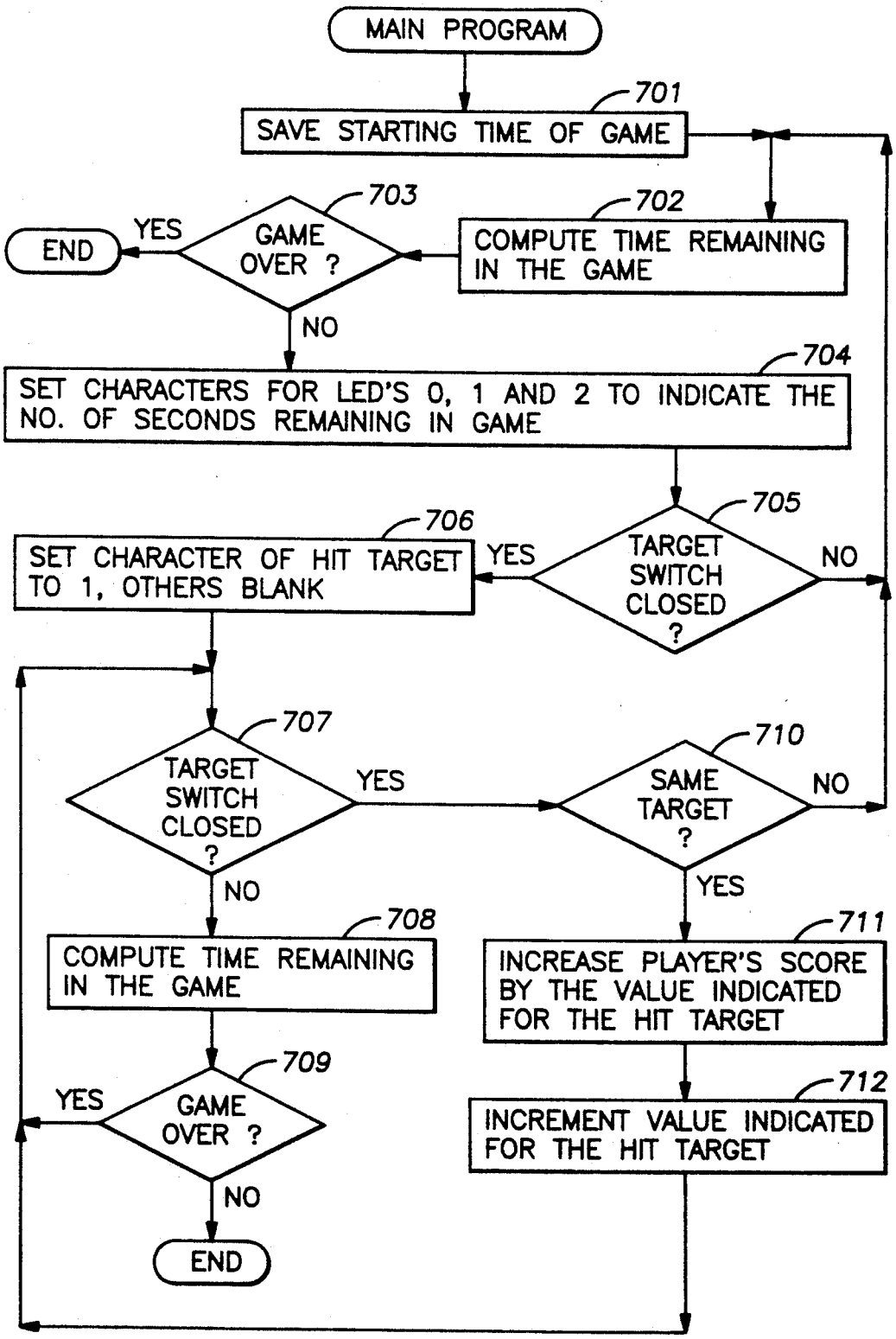
FIG. 7 is a flowchart of a microcomputer main program for a game in which the array of electronic alphanumeric indicators in FIG. 2 are operated in a first mode to display time remaining for the player to complete a task on the playfield, and are operated in a second mode to indicate a score to be awarded the player when a target is hit by the pinball.

Turning now to FIG. 7, there is shown a flowchart 700 of a main program for a game in which the indications from the displays (107 in FIG. 1) are responsive to the targets (104 in FIG. 1). In this example, the displays indicate the time remaining in the game, until one of the targets 104 is hit. To win points, the player must make the ball hit only that same target in succession, and each time that the same target is hit, the player is awarded an increased number of points.

In the first step 701, the starting time of the game is obtained and saved in a memory location of the microcomputer. The microcomputer, for example, has a real-time clock, or computes the present time on a periodic basis, for example, by incrementing a memory location once every 60th of a second in a step (not shown) in the 60 Hz periodic interrupt routine. The starting time of the game is saved so that in step 702, the remaining time in the game can be computed by subtracting the starting time from the present time to compute the elapsed time in the game, and subtracting the elapsed time from a predetermined time limit for the game. Then in step 703 the microcomputer determines whether the game is over by testing whether the elapsed time is less than or equal to zero.

During the game, in step 704 the characters for the LEDs in the displays 107 are set to indicate the number of seconds remaining in the game. This is done, for example, by converting the remaining time in seconds to decimal notation, using a binary-to-decimal conversion algorithm that divides the elapsed time by 100 (64 hexadecimal) to obtain the 100's digit for LED number 1 and a first remainder, dividing the first remainder by 10 (0A hexadecimal) to obtain the 10's digit for LED number 2 and a second remainder, and using the second remainder as the 1's digit for LED number 3.

In step 705, the microcomputer scans the target switches (481, 482, and 483 in FIG. 5) to find a closed switch. The LED's indicate the remaining time in the game until a closed switch is found, signaling that one of the targets (104 if FIG. 1) has been hit by the ball. At this time, in step 706, the digit for the LED display for the hit target is set to 1, and the other LED displays (104 in FIG. 1) are set blank. This indicates to the player, for example, that 100 points will be awarded if the hit target is hit again.

In step 707, the microcomputer again scans the target switches (481, 482, and 483 in FIG. 5) and checks whether a target switch is closed. If not, the remaining time in the game is recomputed in step 708 and the game is terminated in step 709 if the remaining time becomes less than or equal to zero. Otherwise, in step 710, the microcomputer checks whether the closed target switch is the same as the switch that was found to be closed in step 705. If not, the state of the game changes back to computing the time remaining in the game in step 702 and operating the displays in step 704 to indicating the remaining time. Otherwise, in step 711, the player's score is increased by the value indicated by the LED display for the hit target, and in step 708, the value indicated for the hit target is incremented.

Many variations of the invention should be apparent to a person of ordinary skill in the art. For instance, seven-segment or dot-matrix displays could be used instead of sixteen-segment displays. Moreover, liquid crystal or fluorescent displays could be used instead of LED displays.

What is claimed is:

1. A pinball machine having a playfield upon which a ball travels under the influence of a player, said pinball machine further comprising:

a target disposed at a target location on said playfield;

an electronic alphanumeric indicator disposed at said target location on said playfield to display an indication that is associated with the target and that changes during play, said electronic alphanumeric indicator having multiple display elements responsive to respective electronic data signals; and means for controlling said electronic data signals so that said multiple display elements collectively display a selected one of a plurality of alphanumeric characters.

2. The pinball machine of claim 1, wherein said electronic alphanumeric indicator comprises a light emitting diode display.

3. The pinball machine of claim 1, wherein said electronic alphanumeric indicator is located just above and behind said target.

4. The pinball machine of claim 1, wherein said electronic alphanumeric indicator is mounted to a top portion of said target.

5. The pinball machine of claim 1, wherein said target is a drop target.

6. The pinball machine of claim 5, wherein said drop target is transparent, and said alphanumeric indicator is mounted to a back side of said drop target.

7. The pinball machine of claim 1, wherein said target said target is a bumper target, and said electronic alphanumeric indicator is embedded in a top portion of said bumper target.

8. The pinball machine of claim 1, further comprising means for changing said indication to indicate a variable score awarded to said player when said target is hit by said ball.

9. A pinball machine having a playfield upon which a ball travels under the influence of a player, said pinball machine further comprising:

a target disposed at a target location on said playfield;

an electronic alphanumeric indicator disposed at said target location on said playfield to display an indication that is associated with the target and that changes during play;

means for changing said indication to indicate a variable time remaining for said player to complete a task.

10. The pinball machine as defined in claim 9, further comprising means for changing said indication when said target is hit by said ball.

11. A pinball machine having a playfield upon which a ball travels under the influence of a player, said pinball machine further comprising:

a target disposed at a target location on said playfield; and an electronic alphanumeric indicator disposed at said target location on said playfield to display an indication that is associated with the target and that changes during play;

wherein said electronic alphanumeric indicator has a plurality of segments, and wherein said pinball machine further comprises:

a microcomputer providing data signals over at least one data line, and first and second select signals over first and second select lines;

a first flip-flop having an input connect to said data line, an output which drives a first one of said segments, and a clock input connected to said first select line; and a second flip-flop having a data input connected to said data line, a clock input connected to said second select line, and an output which drives a second one of said segments.

12. A method of operating a pinball machine having a playfield upon which ball travels under the influence of a player; said pinball machine having a target disposed at a target location on said playfield, and an electronic alphanumeric indicator disposed at said target location, said electronic alphanumeric indicator having multiple display elements responsive to respective electronic data signals, said target being struck by said ball during a game; said method comprising the steps of:

(a) operating said electronic alphanumeric indicator by controlling said electronic data signals so that said multiple display elements collectively indicate a selected one of a plurality of alphanumeric characters to indicate points awarded to said player when said target is struck by said ball; and (b) operating said electronic alphanumeric indicator to display a changed indication.

13. The method of claim 12, wherein said electronic alphanumeric indicator is also operated to indicate time remaining for the player to perform a task during said game.

14. The method of claim 12, wherein said target and said electronic alphanumeric indicator drop underneath said playfield during said game.

15. A method of operating a pinball machine having a playfield upon which a ball travels under the influence of a player; said pinball machine having a target disposed at a target location on said playfield, and an electronic alphanumeric indicator disposed at said target location, said target being struck by said ball during a game; said method comprising the steps of:

(a) operating said electronic alphanumeric indicator to indicate points awarded to said player when said target is struck by said ball; and (b) operating said electronic alphanumeric indicator to display a changed indication;

wherein said electronic alphanumeric indicator is also operated to indicate time remaining for the player to perform a task during said game.

16. The method of claim 15, wherein said electronic alphanumeric indicator is also operated in said step b) to display a changed indication in response to said target being struck by said ball.

17. A method of operating a pinball machine having a playfield upon which ball travels under the influence of a player; said pinball machine having a target disposed at a target location o said playfield, and an electronic alphanumeric indicator disposed at said target location, said target being struck by said ball during a game; said method comprising the steps of:

measuring time remaining for said player to complete a task with said ball; and operating said alphanumeric indicator to displaying said time remaining for said player to complete said task with said ball;

wherein said measuring and said operating are performed repetitively over a duration of time so that said alphanumeric indicator indicates changing values of said time remaining for said player to complete said task with said ball.

18. The method of claim 17, wherein said electronic alphanumeric indicator is mounted to a top portion of said target.

19. The method of claim 17, wherein said target and said electronic alphanumeric indicator drop underneath said playfield during said game.

20. The method of claim 17, wherein said electronic alphanumeric indicator is further operated to display a changed indication in response to said target being struck by said ball, said changed indication indicating a score awarded to the player when the target is hit again.

* * * * *